United States Patent [19]

White

[11] Patent Number: 4,631,769

[45] Date of Patent: Dec. 30, 1986

[54] COMBINATION TOOL FOR OPENING, SEALING, AND PUNCTURING A PAINT CAN

[76] Inventor: Luther J. White, Rt. 3, Box 241, London, Ky. 40741

[21] Appl. No.: 687,982

[22] Filed: Dec. 31, 1984

[51] Int. Cl.[4] ..... B67B 7/44; B25F 1/00

[52] U.S. Cl. ..... 7/151; 81/3.55; 30/366; D8/34; D8/41

[58] Field of Search ..... 7/151, 152, 156, 105; 30/366, 361, 358, 411, 443, 445, 449, 450; D8/18, 33, 34, 40, 41, 105; 81/3.55, 3.07

[56] References Cited

U.S. PATENT DOCUMENTS

| | | | |
|---|---|---|---|
| D 162,082 | 2/1951 | Preis et al. | D8/18 |
| 2,521,629 | 9/1950 | Byers . | |
| 2,579,980 | 12/1951 | King . | |
| 2,611,950 | 9/1952 | Kaskouras | 30/449 |
| 2,649,989 | 8/1953 | Urbano | 7/152 |
| 2,964,763 | 12/1960 | Nagy et al. . | |
| 3,757,368 | 9/1963 | Thompson . | |

FOREIGN PATENT DOCUMENTS

| | | | |
|---|---|---|---|
| 212051 | 11/1957 | Australia | 30/450 |

*Primary Examiner*—Roscoe V. Parker

*Attorney, Agent, or Firm*—Sandler & Greenblum

[57] ABSTRACT

A tool is provided for use with a paint can and a lid adapted to be positioned within a generally peripherally arranged channel in the paint can. The tool includes first and second spaced prongs and a downwardly extending spike, all of which extend downwardly from the underside of a generally elongated body portion. The tool has a sharp edge which can be used for prying the lid from the can channel. The downwardly extending spike and the second prong are used to form a plurality of apertures in the can channel, and the underside of the first end of the elongated body and the first prong are used to seal the lid in the can channel.

6 Claims, 7 Drawing Figures

COMBINATION TOOL FOR OPENING, SEALING, AND PUNCTURING A PAINT CAN

BACKGROUND OF THE INVENTION

1. Field of the Invention

The present invention generally relates to tools which are used to pry lids from cans, and more particularly to tools multi-function with respect to paint cans and their lids, e.g., the tools are capable of prying lids off of paint cans, perforating the sealing channel of the cans so that excess paint can drain into the interior of the can, and seating and sealing the channel of the lid into the sealing channel of the can in order to seal the lid within the can after it is used.

2. Description of the Prior Art

A number of tools for removing and sealing lids onto containers are known. Flat and thin-bladed objects, e.g., putty knives and screwdrivers, are often used to pry lids from the sealing channel of a paint can. NAGY et al., U.S. Pat. No. 2,964,763, the THOMPSON, U.S. Pat. No. 3,757,368, both disclose tools which are used to pry the lid from a can and for perforating a sealing channel of the can. Other tools used for generally similar purposes include those of BYERS, U.S. Pat. No. 2,521,629 and KING, U.S. Pat. No. 2,579,930.

None of the prior art presently in use, however, discloses a combination tool which is structured so that it can simply and beneficially perform the functions of prying a lid off of a paint can, perforating the paint can channel, and seating and sealing the paint can lid back into the channel after the paint can has been used.

OBJECTS OF THE INVENTION

A general object of the present invention is to provide a new and improved tool which is adapted to remove the closures, e.g., sealing lids, from cans such as paint cans.

Another object of the present invention is to provide a new and improved tool which is capable of perforating and piercing the sealing channel of a paint can so that liquid trapped within the channel after use of the paint can will be able to drain back into the container.

Still another object of the present invention is to provide a new and improved tool which can be used to pry a paint can lid from the paint can and which is adapted to provide increased leverage to facilitate such use.

Yet another object of the present invention is to provide a new and improved tool which can be used to appropriately seat and seal a lid into a paint can in a tight, secure and leak-proof fashion.

A still further object of the present invention is to provide a new and improved tool which is formed from a relatively rigid, yet thin, sheet of material which is sufficiently strong and which can be manufactured at a desirably low cost.

Still a further object of the present invention is to provide a new and improved tool which is contoured in an arcuate fashion so that it will comfortably fit into the hand of a user.

Another object of the present invention will become more apparent to those of ordinary skill in the art from the following description, which accompanies the attached drawings.

SUMMARY OF THE INVENTION

The present tool is adapted to open paint cans and incorporates a spike which is adapted to provide air holes around the rim of the can to facilitate resealing and to better drain the upper channel of the paint can. A hook is provided on one end of the can which facilitates seating and sealing a conventional paint can lid on the can. This combination tool is designed to replace three separate tools currently used by painters, e.g., a screwdriver used to open the can, an awl or pick used to drive holes into the rim of the can, and a hammer used to close the lid. With the present tool, the lid can be removed from the paint can without damaging the edge of the can and permits closure by sealing the lid onto the can without splattering or damaging the lid. A spike is provided to make holes in the upper channel of the paint can to minimize the mess created by material splattering from the rim of the can when struck by a hammer during conventional sealing techniques.

The present invention is provided for in a first aspect thereof by a tool for prying and sealing a lid onto a can. The can has an upper surface and a sealing channel which is impressed in the upper surface about the periphery of the can. The lid also has an impressed channel about its periphery, and is pried from and sealed into the complementarily shaped sealing channel in the upper surface of the can which extends outwardly and which terminates in a bead. The tool can also be used to form holes in the bottom surface of the sealing channel of the can after the lid has been removed. The tool comprises an elongated body having first and second ends, the first end terminating in a relatively sharp edge, the sharp edge comprising means for prying the lid from the sealing channel by inserting it between the periphery of the lid and the bead of the can. The tool also includes means for piercing holes in the sealing channel of the can, as well as means for seating and sealing the lid within the can channel by pressing an upper flat surface of the lid downwardly to force the impressed lid channel into substantial engagement with the sealing channel.

The means for prying the lid from the sealing channel include the sharp edge of the tool located at the first end of the tool. First and second prongs extend downwardly from the underside of the elongated body, both of which are generally arcuate and have respective free ends which are pointed toward the first end of the tool. The free ends of the first and second prongs are adapted to engage the bead of the paint can periphery to assist, respectively, in piercing holes in the channel of the paint can, and to seal the paint can lid in the paint can channel after the can has been used.

The means for piercing holes in the sealing channel comprise the second of said prongs, which is adapted to engage and grip the underside of the bead of the can so that a spike can be inserted into the paint can channel and form a hole therein by being pressed through the bottom of the channel.

The means for seating the lid within the channel comprise the underside of the first end of the elongated body and the first prong, the first prong being used to engage the paint can bead while the first end of the elongated body is pressed downwardly on the lid.

The second end of the elongated body includes a generally circular aperture which is provided for hanging the tool on a hook, nail, or other conventional attaching element inserted into a wall. The tool is preferably made of metal which is sufficiently rigid so that it will not bend when performing the three main functions of the tool.

The tool of the present invention is provided for in a second aspect thereof by an elongated body having a first end and a second end. The elongated body is generally arcuate and has an upper surface and an underside. The first end of the elongated body terminates in a substantially sharp edge which comprises means for removing a paint can lid from a paint can. The lid is removed from the paint can by inserting the free edge of the tool between the lid and a bead extending outwardly from an upper peripheral channel of the paint can. The paint can also includes first and second generally downwardly extending prongs which are spaced apart from one another and which are located adjacent to the first end of the elongated body and on the underside thereof. Both of these prongs are generally curved and have a free end which points towards the first end of the elongated body. The tool also includes a generally downwardly directed inclined spike having a pointed free end which is positioned between the two spaced apart prongs and which is inclined away from the first end of the elongated body so that its free end points towards the second, i.e., rear, end of the elongated body. The second prong and the spike together comprise means for puncturing or piercing holes in the paint can channel, the second prong being used to grip the bead of the paint can while the spike punctures holes at preselected positions about the paint can channel. The first prong, together with the first end of the elongated body, together comprise means for sealing the paint can lid within the channel of the paint can after the paint can has been used, the first prong comprising means for engaging the underside of the paint can bead while the free end comprises means for exerting downward pressure on the upper surface of the paint can lid to force it into the channel of the paint can.

BRIEF DESCRIPTION OF THE DRAWINGS

The above and other objects, features and advantages of the present invention will become more fully apparent to those of ordinary skill in the art to which this invention pertains from a detailed review of the attached drawings, in which like reference numerals are used to identify similar parts throughout, and wherein.

DETAILED DESCRIPTION OF THE INVENTION

Figure 1:
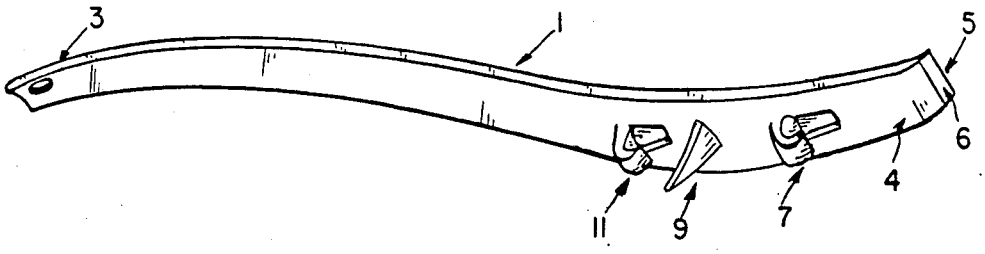
FIG. 1 is a perspective view of the underside of a tool formed in accordance with the present invention.

More specific reference is now made to the drawings, starting with FIG. 1. FIG. 1 illustrates tool 1, which has a generally elongated body having a first end or front portion 5 and a second or rear end portion 3. The tool is generally arcuate and is contoured so that it will easily fit in the hands of a user (see FIGS. 5–7). The tool is made of sheet metal which is sufficiently strong that it will not bend when used as discussed hereinafter.

Figure 2:
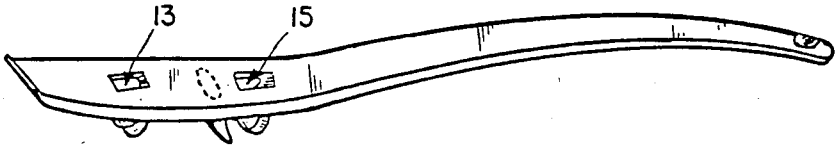
FIG. 2 is a perspective view of the upper surface of the tool of FIG. 1.
Figure 3:
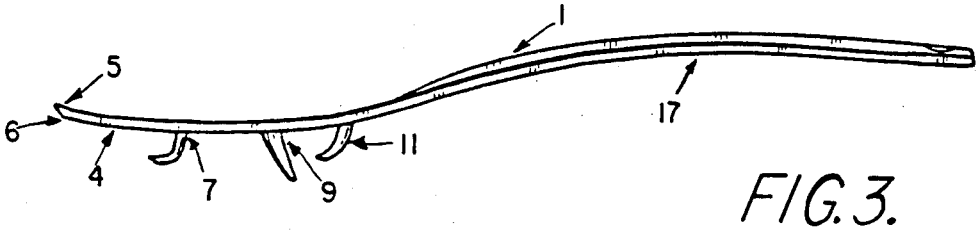
FIG. 3 is a side plan view of the tool of FIG. 1.

The elongated body has an upper surface (unreferenced) and an underside 4. Extending downwardly from the underside are first and second spaced apart grasping or gripping prongs 7 and 11, respectively. First gripping prong 7 is generally arcuate and has a free end (unreferenced) which points towards the front or first end of the elongated body. Spaced second prong 11 similarly is arcuate and has a free end which points towards the front end of the elongated body. The elongated body portion is curved along axis 17 to impart strength to the handle. Both of the prongs are struck from the body itself, and thus form openings or apertures 13 and 15, respectively, in the upper surface of the elongated body (see FIGS. 2 and 4).

The front end of the elongated body is provided with a knife or sharp edge 6 formed at the front end of the tool. Positioned between the first and second prongs, and extending generally downwardly from the underside 4 of the elongated body, is a spike 9 which terminates in a generally pointed tip. The spike is located between the two spaced apart prongs and has a free end which points rearwardly towards the back or second end 3 of the elongated body. As discussed later, this spike is used to puncture or pierce the channel of a paint can.

Figure 4:
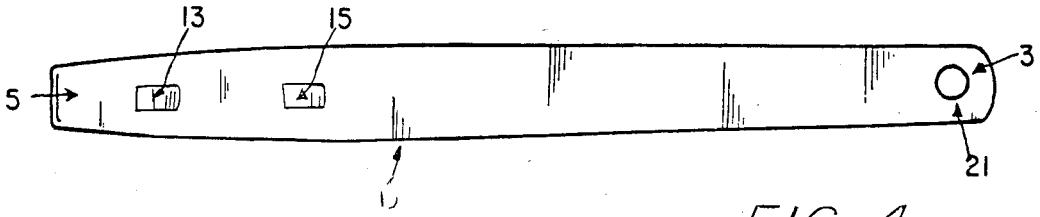
FIG. 4 is a top plan view of the tool of FIG. 1.

As illustrated in FIG. 4, the tool is shaped so that first and second ends 5 and 3, respectively, taper gently from a point of maximum breadth of the tool, located at 19 in FIG. 4. The purpose of this configuration is to concentrate stress at point 19, where the upper surface of the tool changes from a convex configuration to a concave configuration.

Figure 5:
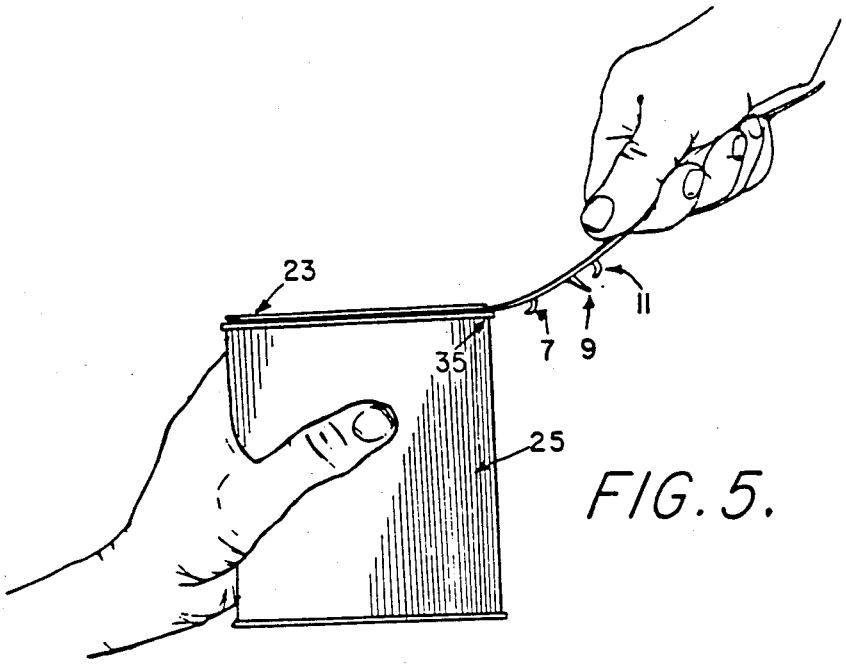
FIG. 5 is a perspective view illustrating the tool as it is used to separate and remove a lid or closure from a paint or similar can.
Figure 6:
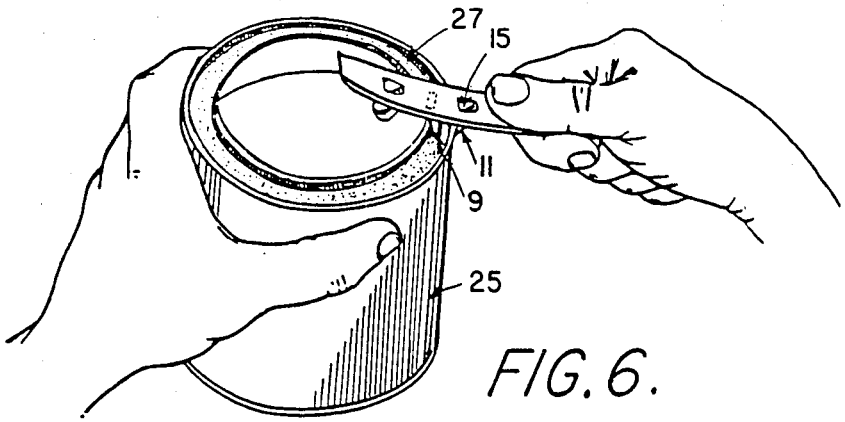
FIG. 6 is a perspective view illustrating the use of the tool to form holes in the channel of the paint can by puncturing or piercing the channel.
Figure 7:
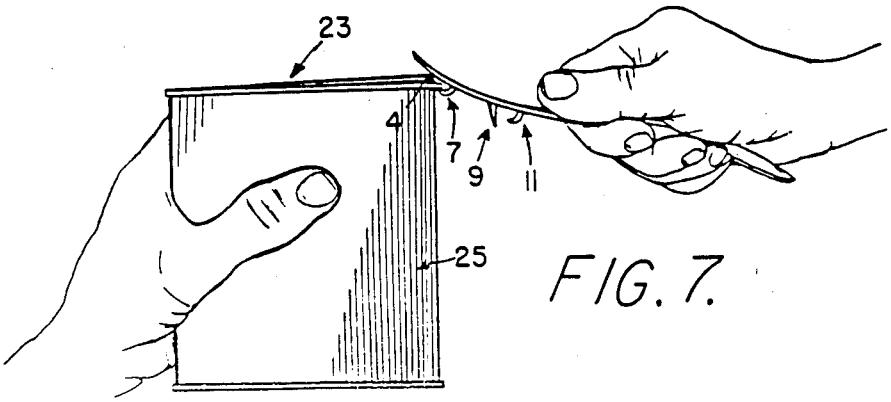
FIG. 7 is a perspective view illustrating the use of the tool of the present invention to force the lid into the sealing channel of the paint can.

The operation of the tool, and its three distinct functions, are well illustrated in FIGS. 5–7. Each of these figures illustrates a paint can 25 having a lower surface and an upper surface with a sealing channel 27 which is generally U-shaped (in conventional fashion). The outermost portion of the channel terminates at an outwardly extending bead 35 (see FIG. 5). The bead extends around the entire periphery of the upper end of the paint can. To open the can, it is necessary to remove lid 23, which has a downwardly extending impressed channel which is adapted to be inserted into the complementarily-configured channel 27. Opener 1 has its sharp or knife edge 6 inserted between the periphery of lid 23 and paint can bead 35. Thereafter, the opener is used as a lever and pressure is exerted by the hand of a user on rear end 3 to force the sharp edge upwardly and to force the periphery of the lid away from bead 35 and outwardly from channel 27 of the paint can.

The second major function of the tool is well illustrated in FIG. 6. As shown in FIG. 6, the second gripping prong 11 has its free end engage the underside of bead 35, while spike 9 is used to pierce the lower surface of channel 27. This occurs by again using the tool in a levered fashion and by the user forcing his hand upwardly to push rear end 3 of the tool upwardly and spike 9 downwardly to puncture or pierce the lower surface of the channel. The purpose of forming these holes in the channel is to provide additional air to the paint can and to allow any paint which has accumulated in the sealing channel of the paint can during use to be drained from the channel and into the can.

The final or third use of the apparatus is well illustrated in FIG. 7. The can lid 23 is positioned over the top of the can, so that its downwardly extending channel (not illustrated) will extend into the complementarily shaped, generally U-shaped sealing channel 27 of can 25. First prong 7 is positioned underneath bead 35 of the can, and again the tool is used as a lever so that the underside portion 4 (at the first tool end) will force the upper surface of the lid, and its lid channel, downwardly into the can sealing channel. This will serve to better seat and to seal the lid into the paint can.

It is obvious from the above that other embodiments, features and characteristics of the present invention will be well within the skill of the art of those of ordinary skill in the art, and that such features and advantages are considered to be within the scope of the present invention

What is claimed is:

1. A tool used in conjunction with a can and a lid for sealing the can, the can having a generally U-shaped sealing channel with a peripherally extending bead, said lid having a downwardly extending impressed channel adapted to be inserted into said U-shaped sealing channel, said tool being adapted to pry said lid from said can, puncture said sealing channel to form holes therein, and seal said lid onto said can after said can has been used, said tool comprising:

(a) an elongated body having a first end, a second end, an upper surface, and an underside, said first end terminating in a sharp edge, said sharp edge comprising means for prying said lid from said can by inserting said sharp edge between said lid and said can bead;

(b) first and second prongs which are spaced apart from each other, both of said prongs extending downwardly from the underside of said elongated body, both of said prongs also having free ends inclined towards said first end of said body;

(c) means for piercing holes in said sealing channel when said lid is removed from said sealing channel, said means for piercing holes in said sealing channel comprising said second prong and a spike extending downwardly from the underside of said elongated body at a position located between said first and said second spaced apart prongs, said spike being angled and having a pointed tip which is inclined towards said second end of said elongated body, said spike being adapted to pierce said sealing channel of said can when a free end of said second prong is positioned under said can bead and the pointed end of said spike is forced through the can channel by leveraging said tool; and (d) means for seating and sealing said lid in said sealing channel by pressing said lid into said sealing channel.

2. A tool in accordance with claim 1 wherein said lid sealing means comprises said first end of said body portion and said first prong, said first end being adapted to force said impressed lid channel into said can sealing channel when said first prong engages said bead and said second end is forced upwardly.

3. A tool in accordance with claim 1 wherein said first and second prongs are stamped from said elongated body such that apertures are created in said body above said first and second prongs.

4. A tool in accordance with claim 1 wherein said second end of said elongated body includes an aperture for hanging said tool from a fastening element.

5. A tool in accordance with claim 1 wherein said tool is formed from metal.

6. A tool used in conjunction with a lid having a generally downwardly extending impressed channel and an outer periphery and a can having an upper end and a generally downwardly U-shaped sealing channel extending about the periphery of said can, said sealing channel having a bead extending generally outwardly from said sealing channel, said tool being adapted to pry said lid from said can, to puncture said sealing channel of said can, and to seat and seal said lid within said sealing channel, said tool comprising:

(a) a generally arcuate and elongated body having a first end and a second end, said first end terminating in a generally sharp edge, said elongated body having an upper surface and an underside;

(b) first and second spaced apart prongs stamped out of said generally elongated body and extending downwardly from the underside of said generally elongated body, both of said prongs including free edges which are inclined towards said first end of said elongated body; and (c) a generally downwardly directed spike extending from the underside of said elongated body portion and having a free pointed end, said free pointed end being directed towards said second end of said elongated body, said sharp edge of said first end comprising means for prying said lid from said can by inserting said edge between the periphery of said lid and said can bead, said second prong and said spike comprising means for forming at least one aperture in said can channel when said free end of said second prong is positioned under said can bead and said pointed end of said spike is forced through said can channel, and said first prong and the underside of said elongated body adjacent said first end together comprising means for sealing said lid into said can channel when the free end of said first prong is positioned under said can bead and the underside of said front end of said elongated body portion is forced downwardly onto the upper surface of said lid.

* * * * *